US005781969A

United States Patent [19]

Akeno et al.

[11] Patent Number: 5,781,969

[45] Date of Patent: Jul. 21, 1998

[54] MOLDED SURFACE FASTENER

[75] Inventors: Mitsuru Akeno; Ryuichi Murasaki, both of Toyama-ken, Japan

[73] Assignee: YKK Corporation, Tokyo, Japan

[21] Appl. No.: 742,197

[22] Filed: Oct. 31, 1996

[30] Foreign Application Priority Data

Jun. 6, 1996 [JP] Japan ..... 8-144167

[51] Int. Cl.[6] ..... A44B 18/00

[52] U.S. Cl. ..... 24/452; 24/442; 24/450; 24/587

[58] Field of Search ..... 24/452, 442, 446, 24/306, 450, 453, 443, 445, 447, 448, 444, 587

[56] References Cited

U.S. PATENT DOCUMENTS

| | | | |
|---|---|---|---|
| 3,338,285 | 8/1967 | Jaster | 24/587 |
| 4,894,060 | 1/1990 | Nestegard | 24/442 |
| 5,067,210 | 11/1991 | Kayaki | 24/442 |
| 5,211,481 | 5/1993 | Tilman | 24/587 |
| 5,212,853 | 5/1993 | Kaneko | 24/452 |
| 5,339,499 | 8/1994 | Kennedy et al. | 24/450 |

FOREIGN PATENT DOCUMENTS

| | | | |
|---|---|---|---|
| 4279103 | 10/1992 | Japan | 24/452 |
| 5229565 | 9/1993 | Japan | 24/587 |

*Primary Examiner*—Victor N. Sakran
*Attorney, Agent, or Firm*—Hill & Simpson

[57] ABSTRACT

A synthetic resin molded surface fastener comprising: a substrate sheet; and a multiplicity of minute engaging elements molded on a front surface of the substrate sheet for engagement with loops of a companion surface fastener. In the molded surface fastener, each of the engaging elements has a multiple-head structure composed of a single stem standing on the front surface of the substrate sheet, two or more necks branching in different directions from an upper end of the stem, and two or more substantially straight engaging heads bent outwardly in branching directions from respective outer ends of the necks. And each of the engaging heads having on its top a pair of substantially horizontal protuberances projecting perpendicularly to an extending direction of each engaging head, the top having a substantially flat surface, each engaging head having a varying thickness gradually decreasing from its base toward its distal end.

30 Claims, 8 Drawing Sheets

MOLDED SURFACE FASTENER

BACKGROUND OF THE INVENTION

1. Field of the Invention

This invention relates to a synthetic resin molded surface fastener composed of a substrate sheet with a multiplicity of engaging elements on the substrate sheet and manufactured by continuous injection or extrusion molding, and more particularly to a molded surface fastener which has minute-size engaging elements for reliable engagement with minute-size loops, which provides adequate engaging strength, adequate peeling resistance and a high rate of engagement, and which has good durability for repeated use, and is suitable for use in diaper, medical clothing, napkin, working clothing, underwear, etc.

2. Description of the Related Art

Integrally molded surface fasteners in which a substrate sheet and a multiplicity of hooks are integrally and continuously molded using thermoplastic resin are disclosed in, for example, U.S. Pat Nos. 4,984,339 and 5,441,687. In recent years, application of this kind of surface fasteners is on the increase as connectors for industrial materials, vehicle or interior ornaments and daily goods as well as various kinds of sanitary goods, such as paper diapers. Consequently, various size and shape of engaging elements formed on a surface of the substrate sheet are required to cope with the above-mentioned various uses.

However, as is understood from the above-mentioned U.S. Patent Specifications, it is a common knowledge that with the conventional molding apparatus for continuous, integrally molded surface fastener, it is difficult to obtain a molded surface fastener that is delicate like a woven surface fastener and excellent in touch in view of technological difficulty in the molding process. Assuming that minute-size engaging elements were molded, only a very low degree of strength could be achieved, so that the resulting molded surface fastener was of little practical use. Further, in the foregoing integrally molded hook-shape structure, the stem has a simple cross-sectional shape and can bend transversely or longitudinally of the engaging element row from its base end much easier when the size of the engaging elements is smaller. In addition, for the simple shape and excessive softness of the hook-shape engaging elements, adequate engaging strength could not be provided so that the engaging elements were too easily removed off the companion loops. As a result, the engaging elements gradually became unable to restore their original posture after repeated use, thus reducing the rate of engagement with the loops in a short period of time. Therefore, in order to obtain adequate rigidness and adequate engaging strength, it was considered necessary to increase the individual hook-shape engaging elements in size, making the resulting engaging elements too rigid and reducing the number of hooks per unit area (hook density). As a result, the molded surface fastener became unable to engage minute-size companion loops.

In order to overcome the foregoing problems, integrally molded surface fasteners having minute-size engaging elements were proposed by, for example, International Publication No. WO94/23610, U.S. Pat. No. 5,077,870, Japanese Patent Laid-Open Publications Nos. Hei 2-5947 (U.S. Pat. No. 4,894,060) and Hei 6-133808.

The engaging elements of the molded surface fastener disclosed in International Publication No. WO94/23610 and U.S. Pat. No. 5,077,870 have a mushroom shape instead of the hook shape. As compared to the hook-shape engaging elements, the mushroom-shaped engaging elements can secure a desired degree strength in engagement with the companion loops though they are reduced to a minute size. Therefore the mushroom-type surface fastener is suitable for uses requiring adequate softness. However, with an engaging element having such structure, the neck portion connecting the stem and its engaging head gets entangled with a plurality of loops at the time of engagement with the companion loops, irrespective whether it is minute or not, so that it tends to be broken at the neck portion, and is therefore not durable for repeated use.

The molded surface fastener disclosed in Japanese Laid-Open Publication No. Hei 2-5947 has an ordinary hook-type structure well known in the art, in which a multiplicity of generally J-shape or palm-tree-shape engaging elements stand on the substrate sheet. However, this molded surface fastener can be manufactured inexpensively and can be used with a non-woven-cloth companion surface fastener, which also can be manufactured inexpensively as compared to an ordinary fiber pile woven cloth. Therefore this molded surface fastener is particularly suitable for use in various disposable underwear and paper diapers. In the molded surface fastener, considering that adequate peeling resistance with respect to pile fibers of a non-woven cloth cannot be obtained by single-head engaging element due to its minute-size, the density of engaging elements is set to be relatively large in an effort to provide general engaging and peeling strength with respect to the minute pile fibers.

In the molded surface fastener disclosed in Japanese Patent Laid-Open Publication No. Hei 6-133808, as viewed in front view, the engaging elements have a T shape or an inverted L shape. The height of the lower surface of the engaging head, length of the head, thickness of the head, width of the head, projected area of the head, and distance between laterally adjacent engaging elements are set to very small numerical values. These values are almost the same as those of the foregoing minute-size engaging elements. According to this molded surface fastener, using a unique shape of the engaging elements different from that of the conventional engaging elements, it is possible to secure smooth engaging and peeling action and soft touch as well as necessary engaging strength as a whole compared to the molded surface fastener having ordinary-shaped, minute engaging elements.

By merely making the engaging element very small in size and large in density or only changing the shape of the engaging elements into a simple one, it is not assured that the shearing strength and the peeling strength during engagement with the companion non-woven cloth can increase though the rate of engagement with the non-woven cloth increases. Even if the density of the hook-shape engaging elements is extremely large, the engaging heads push down the very soft fiber loops, which are closely and random arranged, of the companion non-woven cloth or fall flat themselves when an attempt is made to penetrate the hook-shape engaging heads into the dense fiber loops. As a result, the engaging elements become unable to penetrate into the fiber loop, so a lowered rate of engagement as compared to the ordinary surface fastener cannot be avoided.

For the foregoing reasons, in the molded surface fastener having the above-mentioned minute-size engaging elements, limitation would necessarily occur either in reducing the size of the engaging elements or in increasing the density of the engaging elements. The disclosure of Japanese Patent Laid-Open Publication No. Hei 2-5947 is totally silent about critical values, though the preferable parameters of various portions of the engaging element are merely stated, for example, the density of engaging elements is 70–100/cm$^2$, the height of engaging elements is 0.8–1.1 mm, the thickness of stem and the width of engaging head (horizontal width perpendicular to an extending direction of the engaging head) is 0.46 mm, the width of the stem (thickness in the extending direction of the engaging head) is 0.18–0.30 mm, and the length of engaging head projecting from the stem is 0.25–0.37 mm or less than 1 mm. These numeral values are determined to provide the integrated strength in both the shearing direction and the peeling direction, based on a recognition that the shearing strength and the peeling strength during engaging of a single engaging element are extremely low, due to the fact that the engaging element has an ordinary shape, i.e. no unique shape for minute size.

Assuming that the engaging element has an ordinary J shape, it is necessary to set the distance between the lower end of the distal end of the engaging head and the uppermost point of the engaging head as small as possible, and to set both the distance between the lower end of the distal end of the engaging head and the front surface of the substrate sheet and the distance between adjacent engaging hooks at least several times larger than the actual size of the companion loops. Consequently, the parameters of the conventional engaging element are decided in relation to the size of the companion loops. For example, even when molding the very soft and minute-size engaging elements suitable for use in paper diapers, it is inevitable to set the curvature of the engaging head large in order to provide necessary engaging strength, and the minimum necessary distance between the lower end of the distal end of the engaging head and the front surface of the substrate sheet for the loop to enter is decided initially.

This means that, when securing a predetermined rate of engagement, either the height or density of the engaging element is initially decided so that the height cannot be set to a lower value. Therefore, assuming that either the resin material and the hook weight is constant, it is difficult to improve the strength in both the shearing direction and the peeling direction during engagement as long as the engaging element structure is improved. Also, since the uppermost point of the engaging head of the engaging element rising directly from the front surface of the substrate sheet is curved, it is impossible to make the touch of the engaging-side surface of the surface fastener smoother, and this curved shape would be a cause for increasing the size of the companion loop, and would obstruct the insertion of the engaging head into the loop when the loops are to be smaller. Further, even if the whole engaging element is merely reduced into a minute size, the whole hook-shape engaging head would inevitably be flexed forwardly or sideways as if depressed so that the engaging head becomes further unable to engage the companion loops, thus lowering the rate of engagement of the whole surface fastener considerably.

With the molded surface fastener disclosed in Japanese Patent Laid-Open Publication No. Hei 6-133808, it is estimated that, because of its shape, the engaging strength of the single engaging element with respect to the companion loop is further lowered as compared to the molded surface fastener disclosed in the foregoing publications. Consequently attempts have been made in arrangement of the engaging elements to compensate for the further reduction of the engaging strength. However, the concept of securing the integrated engaging strength of the molded surface fastener like the above-mentioned inverted J-shape engaging elements is similar to that of the molded surface fastener having the minute-size engaging elements. It is therefore necessary to define, in addition to the above-mentioned factors, various other factors in order to secure the integrated engaging strength to complement the lowering of the engaging strength in the individual engaging element.

In the T shape or inverted L shape engaging element of the last-named publication, it is not positively intended to reduce the thickness of the engaging head gradually from its base end toward its distal end, but actually it is described to be preferable to taper the distal end of the engaging head. Namely, it merely describes that the thickness of the engaging head at the central portion is preferably 0.08–0.35 mm. However, according to this publication, the engaging element is not processed with any treatment to increase its rigidity or is not modified over the above-mentioned shape. It is understandable that the thickness of the engaging head cannot be smaller than 0.08 mm as long as the whole rigidity depends on the rigidity of the material itself.

Generally, when making the engaging elements minute in size, the thickness of the substrate sheet must be reduced in order to secure adequate softness of the whole surface fastener. However, if the thickness of the substrate sheet is very small, it tends to extend uniformly or to be easily torn out when the engaging elements of the molded surface fastener is separated from the die during continuous molding, thus causing non-stable molding. Yet if the molding itself could be finalized without trouble, the molded substrate sheet would become more wavy or puckered as it is reduced more in thickness, thus making the molded surface fastener commercially unsatisfactory.

SUMMARY OF THE INVENTION

It is therefore an object of this invention to provide a molded surface fastener which can reliably engage even minute dense fiber pile as of a non-woven cloth, can secure adequate engaging strength and adequate shearing and peeling resistance for individual engaging elements, can improve the touch of the engaging-side surface, can be reduced in height of engaging elements above the front surface of a substrate sheet as compared to the conventional surface fastener, can prevent engaging heads from deforming due to pressure, can secure a high rate of engagement with the loops of the companion surface fastener, have adequate durability against repeated loading, and can secure desired softness and tearing strength of the substrate sheet.

According to this invention, the above object is accomplished by a synthetic resin molded surface fastener comprising: a substrate sheet; and a multiplicity of minute engaging elements molded on a front surface of the substrate sheet for engagement with loops of a companion surface fastener. In the molded surface fastener, each of the engaging elements has a multiple-head structure composed of a single stem standing on the front surface of the substrate sheet, two or more necks branching in different directions from an upper end of the stem, and two or more substantially straight engaging heads bent outwardly in branching directions from respective outer ends of the necks. And each of the engaging heads has on its top a pair of substantially horizontal protuberances projecting perpendicularly to an extending direction of each engaging head, the top having a substantially flat top surface. Each eangaging head has a varying thickness gradually decreasing at least around its distal end.

Preferably, an uppermost point of each engaging head is spaced from the front surface of the substrate sheet by a distance of 0.2–1.2 mm, each engaging head projecting from the stem to an extent of 0.05–0.7 mm, and the stem having a height of 0–1.0 mm. These numerical ranges are basic numeral ranges enough for the engaging elements to secure engagement with minute loops (pile) of a companion surface fastener and to be free of a rigid touch at the time of engagement and disengagement. Especially the lower limit values are values such that the engaging elements can reliably engage even the minutest fiber pile of an ordinary non-woven cloth.

Further, when a total area of the flat top surfaces of the tops of the engaging heads is 20–50%, preferably 32–40%, of the area of the front surface of the substrate sheet, it is possible to secure a required rate of engagement with the loops of the companion surface fastener and to eliminate an itchy touch on the engaging surface of the molded surface fastener. When a continuous length of the molded surface fastener having the above-described structure is attached onto paper diapers continuously, the molded surface fastener is continuously fed and successively cut into a predetermined length, and the cut surface fasteners are fed in an arcuate path along rotation of a suction roller as their engaging surfaces are sucked onto a number of fixed sucking portions arranged in and along the circumferential surface of the roller. The cut surface fasteners are then attached successively to the individual paper diapers being supplied in a traveling path perpendicular to the circumferential surface of the roller. Accordingly, as it is necessary to feed the cut surface fasteners while they are sucked onto the circumferential surface of the roller efficiently and reliably, given that the ratio of the total area of the flat top surfaces of the tops of the engaging heads to the area of the entire front surface of the substrate sheet is set in the above-defined range, it is possible to absorb the cut surface fasteners to the circumferential surface of the suction roller reliably.

Also preferably, each engaging head has a width, perpendicular to projection of the engaging head, 50–70% of the sum of the total length of the pair of protuberances and the width of the engaging head. Namely, the total width of the pair of protuberances projecting is 30–50% of the sum of the width of the engaging head and the total width of the pair of protuberances. In the presence of these protuberances, it is possible firstly to make the top surfaces of the engaging heads substantially flat to improve the itchy touch of the top, and secondly to relatively reduce the height of the uppermost point of the engaging head from the front surface of the substrate sheet, without changing the height of the bottom surface of the engaging head from the front surface of the substrate sheet, if the same quantity of resin is used for the top of the engaging head including the protuberances. Therefore it is possible not only to make the engaging elements minute but also to leave the front surface of the substrate sheet merely flat without forming any recesses.

A third function of these protuberances, unlike the function of the conventional hook-shape engaging head having a substantially uniform size, with which the companion loop merely engages, is that the individual loop of the companion surface fastener can be wound around the neck between the stem and the protuberances so as not to be easily removed off the engaging head, thus increasing the engaging strength sharply. However, unlike the conventional mushroom-type engaging element having an umbrella-shape engaging head projecting in all directions from the upper end of the stem, since the engaging heads branch and extend radially from the stem, even if the engaging head hangs at its neck by the loop, the loop is allowed to smoothly move around the protuberances with a slight resistance, by a separating force greater than that with the conventional ordinary hook-shape engaging head and smaller than that with the conventional umbrella-shape engaging head, as the engaging head resiliently deforms via the neck to stand up when a peeling force is exerted on the surface fastener. As a result, it is possible to secure a required degree of engaging strength, despite of the minute size of the engaging heads, without causing any damage to either the engaging elements and the loops.

Further, in the presence of the protuberances, it is possible to modify the shape of the engaging head. Namely, since the protuberances cause an increased degree of engaging strength with the loops as mentioned above, it is possible to bend the whole engaging element into a generally inverted L shape with the engaging head projecting substantially straightway without curving downwardly toward the substrate sheet like the conventional hook-shape engaging head. This facilitates inserting the engaging head through even the minute-size loops, such as short and minute single-fiber pile bristling as part of an ordinary non-woven cloth.

For the minute-size and single-fiber pile, it is preferable that the flat top surface of the top of each engaging head is inclined with respect to the horizontal plane by an angle $\theta$ satisfying a relation $0<\theta\leqq 35°$ and that the lower surface of each engaging head is inclined with respect to the horizontal plane by an angle $\theta'$ satisfying a relation $5\leqq\theta\leqq 45°$. At the same time, it is particularly useful if each engaging head has at its distal end portion a vertical thickness 50–90% of the thickness at its base portion. With the above-described inclined configuration, it is more impossible to obtain the engaging strength with the companion loop than the conventional J-shape or mere inverted L-shape engaging element. Most preferably, each engaging head or at least the top including the protuberances has a higher degree of rigidness than the stem and the remaining portion of the engaging element in order to increase the resistance of the engaging head against separation from the companion loops and to stabilize the shape of the engaging head.

It is also preferable that the stem stands upright on the front surface of the substrate sheet and has an engaging-head-projecting-side surface disposed substantially centrally under the top of the engaging head in order to surely support the engaging head on its bottom side when the engaging element is pressed and to prevent the engaging head from being easily deformed. In general, since this kind of molded surface fastener is continuously manufactured in the form of a continuous length of tape and is wound up in a roll for stock and transportation, engaging elements standing on the front surface of the substrate sheet tend to deform due to the great pressure. However, having the engaging-head-projecting-side surface disposed substantially centrally under the top of the engaging head as described, it is possible to make the engaging elements adequately resistant against the pressure.

Further, when confronting inner surfaces of the necks of each engaging element extend from a central position of the upper end of the stem and are inclined away from each other and when the bottom of a hollow defined between the confronting inner surfaces of the necks is disposed substantially in a horizontal plane passing lower ends of bottom surfaces of the engaging heads, it is possible to make the individual necks easier to resiliently deform compared to the stem so that the companion loops can come into and out of engagement with the engaging heads smoothly.

Furthermore, if the substrate sheet has at predetermined positions in the front surface a predetermined number of recesses, bottom surfaces of which the engaging elements stand on, the apparent height of the engaging elements projecting from the substrate sheet is equal to the result of subtracting the depth of the recess from the actual height of the engaging elements, even though the actual height of the engaging elements is the same as conventional. Namely, even if the distance between the lower end of the distal end of the engaging head and the bottom of the base end of the stem (the bottom surface of the recess) is the same as conventional, the distance between the lower end of the individual engaging head and the recess-free area of the front surface of the substrate sheet is equal to the difference between the actual height of the individual engaging element from the base end of the stem and the depth of the recesses.

Having these recesses in its front surface, the substrate sheet can be improved remarkably in softness though its apparent thickness is the same as convention. Also this substrate sheet can be kept from excessive expansion or ripping when the surface fastener is peeled off the die after molding. As a result, a high quality product free of puckering in the substrate sheet and adequately durable can be obtained. Further, when the height of the stem of each engaging element from the bottom surface of the corresponding recess is ⅕–9/10 of the height of the uppermost point of the engaging head from the bottom surface of the recess, it is possible to increase the degree of softness of the engaging head in the present of the neck and to reduce the apparent height of the stem above the recess-free area of the front surface of the substrate sheet so that the stem is hard to bend, thus stabilizing the shape of the stem when the engaging element comes into engagement with the companion loop. Further, each of the recesses has a width such as to receive the loops of the companion surface fastener.

This molded surface fastener can be continuously manufactured in the following manner. Molten resin is continuously injected or extruded toward the circumferential surface of a rotating die wheel from an injection or extrusion nozzle under a predetermined resin pressure so that part of the molten resin is shaped into a substrate sheet along the circumferential surface of the die wheel while the remaining part of the molten resin is successively filled in a multiplicity of engaging-element-forming cavities, which is formed in the circumferential surface of the die wheel, to form a multiplicity of engaging elements integral with the substrate sheet. As a result, a primary-intermediate, or semiproduct, molded surface fastener is continuously molded. The individual engaging-element-forming cavities are bent by an angle of 90°–180° the distal ends of the individual engaging element blanks are pressed by heating and pressing means (described below) to reduce the angle of bending and to form protuberances, thus completing the engaging elements having the above-mentioned shape.

As it is moved along substantially a half of the circumferential surface of the die wheel, this primary-intermediate surface fastener is positively cooled by a cooling water jacket mounted in the die wheel and, at the same time, the primary intermediate surface fastener is moved in and through a cooling water bath, in which low-temperature cooling water circulates, and is thereby quickly cooled to facilitate solidification. Since the primary-intermediate molded surface fastener is solidified by this quick cooling before crystallization of the molded surface fastener starts, it is possible to make the whole substrate sheet and all of the engaging elements adequately soft. Accordingly, the molded surface fastener is more suitable for use in underwear, paper diaper, patient clothing, etc., all requiring an adequate degree of softness.

When the solidified substrate sheet is separated from the circumferential surface of the die wheel by a vertical pair of take-up rollers, the individual cooled and solidified engaging elements are drawn successively from the engaging-element-forming cavities smoothly as they resiliently deform into a straight shape. Especially if the confronting inner surfaces of the necks of each engaging element extend from the central position of the upper end of the stem and are inclined away from each other as mentioned above, the engaging elements can be easily removed off the cavities since the thickness of the engaging head is smaller than about ½ of the thickness of the stem in the extending direction of the engaging head.

Then the top of the individual engaging head of the primary-semiproduct molded surface fastener is heated and pressed by the heating and pressing means to be softened while being slightly inclined. As a result the upper surface of the top is deformed into a substantially flat surface and, at the same time, is expanded so as to form a pair of protuberances projection in opposite directions. Thus, the molded surface fastener of the invention, in which a multiplicity of engaging elements having above-described structure stand on the surface of the substrate sheet, is manufactured.

Important in the foregoing manufacturing example, the molded surface fastener passed through the heating and pressing means is slowly cooled at normal, ambient, temperature, without being positively cooled by independent cooling means, whereupon the cooled surface fastener is wound up in a roll to finalize the manufacturing. When the heated and deformed top of the engaging head is slowly cooled to become solidified, the heated portion is crystallized so that the engaging head would increase in rigidness as compared to the stem. Specifically, since the engaging heads have an increased degree of rigidness as compared to the substrate sheet and the engaging elements, which are quickly cooled to retard crystallization and hence to become excellent in softness, it is possible to secure adequate rigidness of the engaging heads, even though the engaging elements are minute in size and very high in softness, guaranteeing a required degree of strength in the peeling direction.

DETAILED DESCRIPTION OF THE PREFERRED EMBODIMENTS

Figure 1:
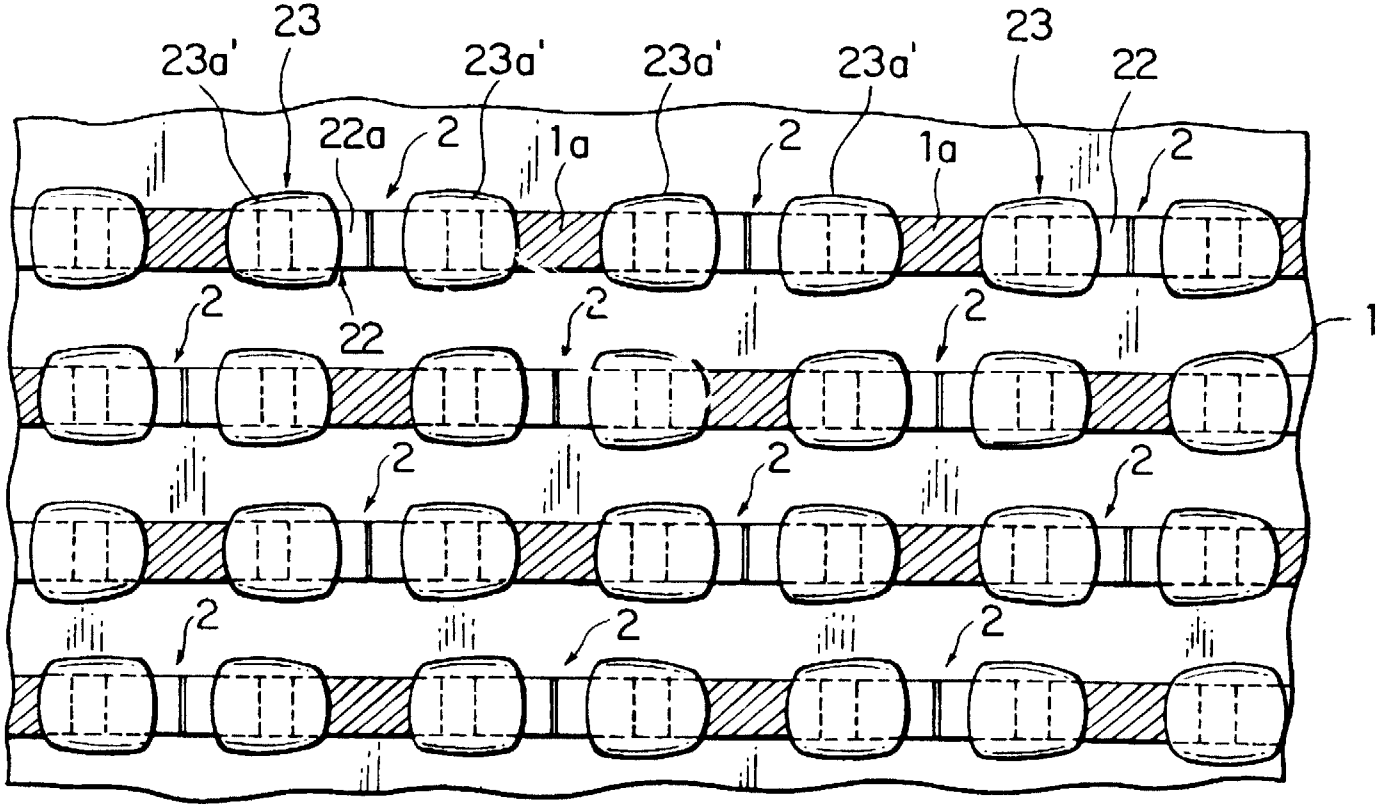
FIG. 1 is a fragmentary plan view of a molded surface fastener according to a first embodiment of this invention.
Figure 2:
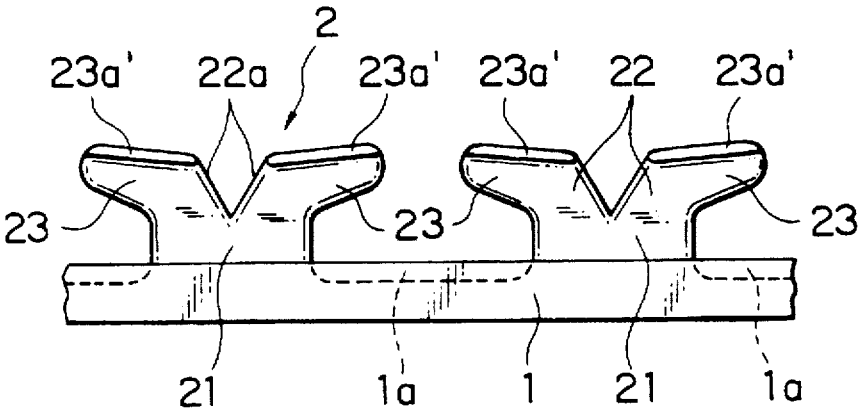
FIG. 2 is a fragmentary side view of the molded surface fastener.
Figure 3:
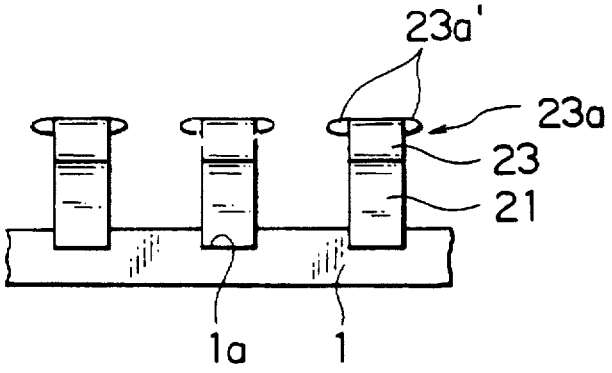
FIG. 3 is a fragmentary front view of the molded surface fastener.
Figure 4A:
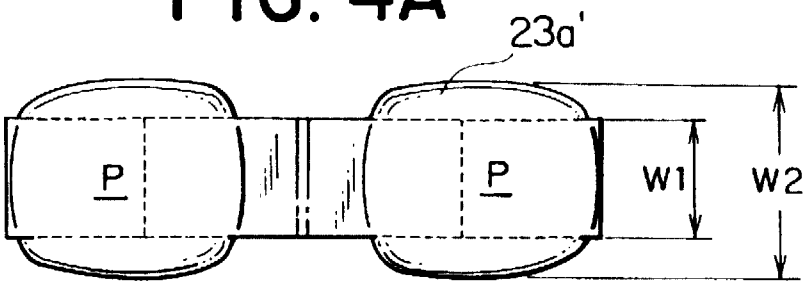
FIGS. 4(A), 4(B) and 4(C) are fragmentary enlarged plan, side and front views, respectively, of an engaging element of the molded surface fastener.
Figure 4B:
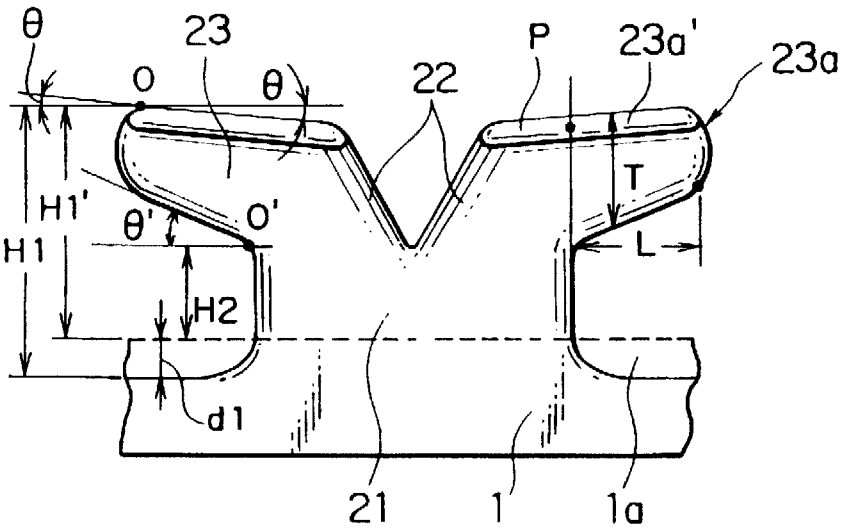
Figure 4C:
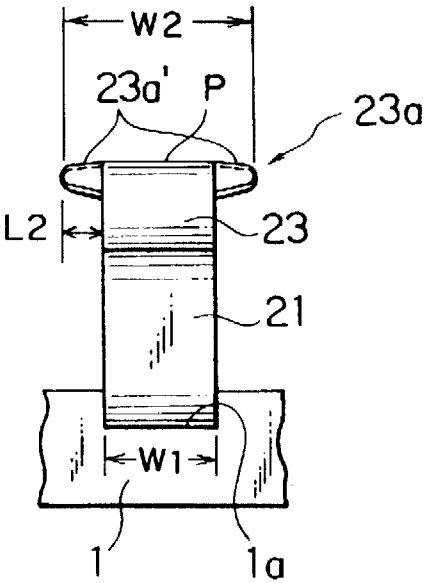
Figure 5:
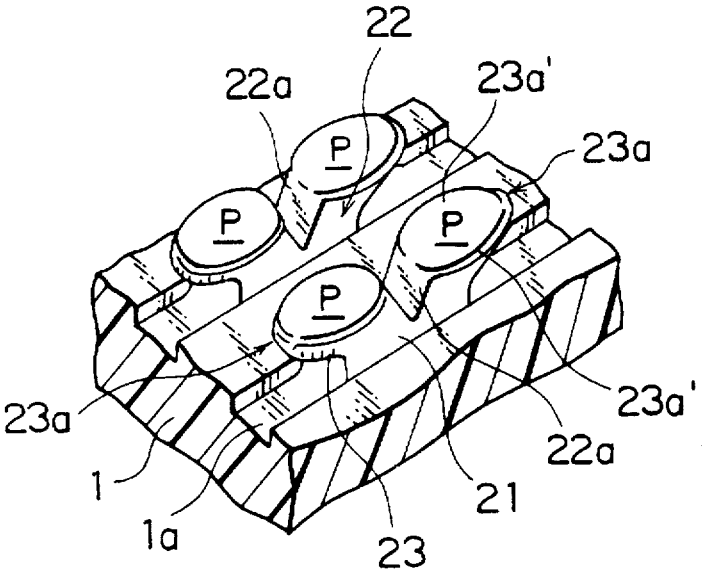
FIG. 5 is a fragmentary perspective view of the molded surface fastener.

Preferred embodiments of this invention will now be described in detail with reference to the accompanying drawings. FIG. 1 is a fragmentary plan view of a molded surface fastener according to a first embodiment of this invention, FIG. 2 is a fragmentary side view of the molded surface fastener, FIG. 3 is a fragmentary front view of the molded surface fastener, and FIGS. 4(A), 4(B) and 4(C) are fragmentary enlarged plan, side and front views, respectively, of an engaging element of the molded surface fastener.

The molded surface fastener comprises a substrate sheet 1, and a multiplicity engaging elements 2 standing on a front surface of the substrate sheet. Each of the engaging elements 2 is a double-head structure having a single stem 21 standing in an upright posture on the front surface of the substrate sheet 1, a pair of necks 22 branching from the upper end of the stem 21, and a pair of straight engaging heads 23 extending outwardly via respective necks 22 and slightly upwardly sloping to their distal ends. In this embodiment, the two engaging heads 23 extend in opposite directions. Alternatively, each engaging element 2 may be a multiple-head structure having three or more engaging heads projecting in different directions from a single stem. It is preferable that the engaging heads 23 project radially outwardly in order to make the engaging elements 2 free of directivity in engaging with loops of a companion surface fastener.

Figure 6:
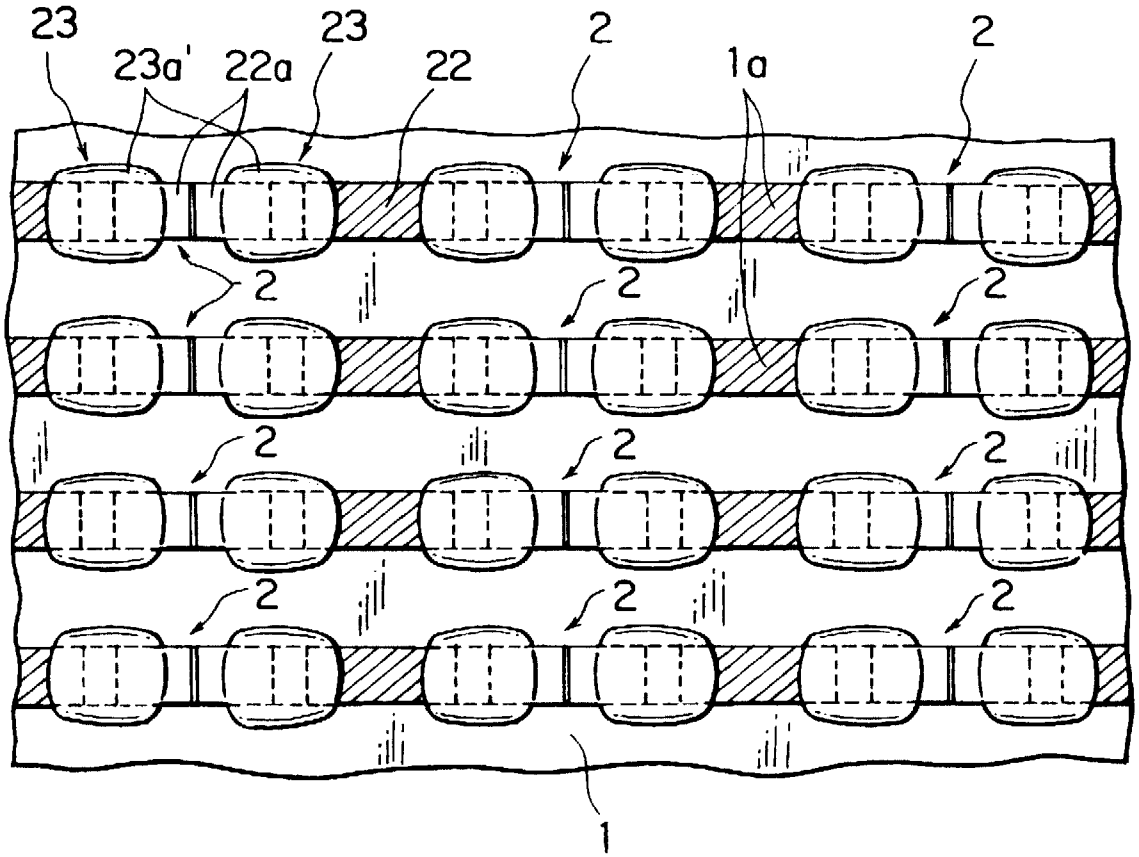
FIG. 6 is a fragmentary plan view of the molded surface fastener, showing an example of arrangement of engaging elements.

In this embodiment, the substrate sheet 1 has in the front surface, rows of recesses 1*a* arranged in a row direction of the engaging elements, from bottom surfaces of which the stems 21 of the engaging elements 2 stand upright at a predetermined pitch. Opposite side surfaces of the individual stems 21 are integral with opposite side walls of the recess 1*a*; as a result, each recess 1*a* is divided into a multiplicity of sections by the individual stems 21. According to the illustrated example, the engaging elements 2 are arranged in straight rows of a common direction, and a plurality of rows are arranged in parallel. The arrangement of the recess sections 1*a* should by no means be limited to the foregoing and they may be disposed perfectly independently of one another. The recess sections 1*a* shown in FIG. 1 along each adjacent pair of engaging element rows are arranged in a staggering pattern on the front surface of the substrate sheet 1, but the recess sections 1*a* may be arranged in a checkered pattern, as shown in FIG. 6.

In the surface fastener SF of this embodiment, through a distance H1 between an uppermost point 0 of the distal end of the engaging head 23 and the base end (bottom surface of the recess 1*a*) of the stem 21 is the same as conventional, a distance H1' between the uppermost point 0 of the distal end of the engaging head 23 and the recess-free area of the front surface of the substrate sheet 1 is equal to the difference between the distance H1, i.e. the actual height of the engaging element 2, and a depth d1 of the recess 1*a*. This means that though the actual height H1 of the engaging element 2 standing on the substrate sheet 1 is the same as conventional, an apparent height H1' of the engaging element 2 above the front surface of the substrate sheet 1 is shorter than the actual height H1 by the depth d1 of the recess 1*a*. Having these recesses 1*a* in its front surface, the substrate sheet 1 can be improved remarkably in softness though its apparent thickness is the same as convention. Also this substrate sheet 1 can be kept from excessive expansion or ripping when the surface fastener SF is peeled off the die after molding. As a result, a high quality product free of puckering in the substrate sheet 1 and adequately durable can be obtained.

When the engaging element 2 of the surface fastener SP of this embodiment engages the companion loop, the distal end of the loop comes under the engaging head 23 as guided by the recess 1*a* to reach the base end of the stem 21 of the engaging element 2 so that the engaging head 23 is inserted through the loop smoothly.

For a first feature of the engaging element 2 of the invention, as shown in FIG. 4 in an enlarged scale, a top 23*a* of the engaging head 23 as seen from the above defines a flat top surface P except the distal end. And the flat top surface P has an egg-shape cross-section. Of course, the cross-section of this flat top surface P should by no means be limited to the egg-shape and may be such that the respective longest cords of two identical semi-ovals are attached to two longer sides of a rectangle, or any other similar shape. It is preferable that the total area of the flat top surfaces P of all the engaging heads 23 is 20–50% of the area of the entire front surface of the substrate sheet 1. Seeing the engaging element from the front side, as shown in FIG. 4(C) in an enlarged scale, it is understood that part of the flat top surface P of the engaging head 23 bulges from its opposite sides to form a pair of protuberances 23*a*'. Preferably, each of the protuberances 23*a*' has a width such that a width W1 perpendicular to an extending direction of the engaging head 23 is 50–70% of a width W2 which is a width in the same direction including the two protuberances 23*a*'.

For a second characteristic feature of the engaging element 2, the engaging head 23 bending and extending straight via the neck 22 has a unique shape as seen from the side. As shown in FIG. 4(B), the engaging head 23 has a varying thickness T gradually decreasing from its base end 0' toward its distal end. This decrease rate ΔT is preferably 10–50%. Also in this embodiment, the flat top surface P of each engaging head 23 is inclined with respect to the horizontal plane by an angle θ satisfying a relation $0<\theta\leqq 35°$, and the lower surface of each engaging head 23 is inclined with respect to the horizontal plane by an angle θ' satisfying a relation $5\leqq\theta\leqq 45°$. As a result, the whole engaging head 23 extends straightway sloping slightly upwardly toward its distal end. Further, the angle θ of inclination of the flat top surface P of the engaging head 23 is set to a relatively slightly smaller value as compared to the angle θ' of inclination of the lower surface of the engaging head 23. Accordingly, even though the companion loop is short in height and minute in size, it is possible to insert the engaging head 23 into the loop and to allow the loop to reach the base end of the engaging head 23 smoothly.

Further, in this embodiment, the whole of the engaging head 23, or at least the top 23*a* including the protuberances 23*a*', has a higher degree of rigidness than the stem 21 and the remaining portion of the engaging element 2 in order to increase the resistance of the engaging head 23 against separation from the companion loops and to stabilize the shape of the engaging head 23. The stem 21 stands upright on the front surface of the substrate sheet 1 and has an engaging-head-projecting-side surface disposed substantially centrally under the flat top surface P of the engaging head 23 in order to surely support the engaging head 23 on its bottom side when a large pressing force is exerted to the top 23*a* of the engaging element 2 standing on the surface of the substrate sheet 1 and to prevent the engaging head 23 from being easily deformed. Therefore, it is possible to make the engaging elements 2 adequately resistant and less deformable against pressure.

Further, in this embodiment, a pair of confronting inner surfaces 22*a* of the necks 22 of each engaging element 23 extend from a central position of the upper end of the stem 21 and are inclined away from each other. In the illustrated example, the confronting inner surfaces 22*a* of the two necks 22 define between them a substantially V-shape hollow. This hollow may be a generally U shape or any other similar shape. Although the bottom of the hollow defined between the confronting inner surfaces 22*a* of the necks 22 may be disposed at a desired position, it should be disposed preferably in or slightly under a horizontal plane passing lower ends of bottom surfaces of the engaging heads 23. Because of this deep hollow, it is possible to make the individual necks 22 easier to resiliently deform so that the companion loops can come into and out of engagement with the engaging heads 23 smoothly.

As shown in FIGS. 4(A), 4(B) and 4(C) in which the engaging element 2 is shown in an enlarged scale, the height H1' between the uppermost point 0 of the distal end of the engaging head 23 and the front surface of the substrate sheet 1 is 0.2–1.2 mm, a length L1 of the engaging head 23 from the stem 21 is 0.05–0.7 mm, and a height H2 of the stem 21 above the front surface of the substrate sheet 1 is 0–1.0 mm. The height H2 of the stem 21 is a distance from the recess-free area of the front surface of the substrate sheet 1 and the uppermost point 0 of the distal end of the engaging head 23; in the presence of the recesses 1*a* in the front surface of the substrate sheet 1, the height H2 of the stem 21 is 0 mm when the stem 21 has a height corresponding to the depth d1 of the recess 1*a*. In the absence of the recesses 1*a* in the front surface of the substrate sheet 1, if the height H2 of the stem 21 is 0 mm, that means no stem 21 exists, and a number of engaging heads 23 rising in a gently inclined posture directly from the front surface of the substrate sheet 1 via a number of necks 22, respectively.

Regarding the engaging element 2 of FIG. 4, an example of parameters are as follows. The distance H1' between the uppermost point 0 of the distal end of the engaging head 23 and the front surface of the substrate sheet 1 is 0.297 mm (the height H1 from the bottom surface of the recess 1*a* is 0.348 mm), the length L1 of the engaging head 23 from the stem 21 is 0.152 mm, and the height H2 of the stem 21 above the front surface of the substrate sheet where the recess 1*a* does not exist is 0.125 mm. The angles θ inclination of the flat top surface P of the engaging head 23 is 13.3°, the angle θ' of inclination of the lower surface of the engaging head 23 is 20.6°, the width W2 of the total length of the top 23*a* with two protuberances 23*a*' is 0.263 mm, the width W1 of the stem 21, the neck 22 and the engaging head 23 excluding the top 23*a* is 0.15 mm, the thickness L2 of the protuberance 23*a*' in a bulging direction is 0.56 mm, the total area of the flat top surfaces P of all the engaging heads 23 is 35% of the area of the front surface of the substrate sheet 1, and the density of the engaging elements 21 is 250/cm$^2$. These numeral values, which are only as an optimum example, should by no means be limited to these values and may be changed as desired in relation to the companion loops.

In the presence of the protuberances 23*a*', the engaging element 2 of this invention can display the following useful functions, which could not have been expected with the conventional mere inverted J-shape, L-shape or T-shape engaging elements.

For a first function, it is possible to define a substantially flat surface P on the top 23*a* of the engaging head 23, giving a less itchy, smooth feeling, touch to the top 23*a*. For a second function, assuming that the quantity of resin for the top 23*a* of the engaging head 23 including the protuberances 23*a*' is the same, it is possible to make the height of the uppermost point of the top 23*a* of the engaging head 23 above the front surface of the substrate sheet relatively short without changing the height of the lower surface of the engaging head 23 above the front surface of the substrate sheet 1. Therefore it is possible not only to make the engaging elements 23 minute but also to leave the front surface of the substrate sheet 1 merely flat without forming any recesses of FIGS. 1 through 3.

For a third function, unlike the fyunction of the conventional engaging head of a hook-shape having a substantially uniform size with which the companion loop engages, in the presence of the protuberances 23*a*', the individual loop of the companion surface fastener can be wound around the neck 22 between the stem 21 and the protuberances 23*a*' so as not to be easily removed off the engaging head 23, thus increasing the engaging strength sharply. Moreover, unlike the conventional mushroom-type engaging element having an umbrella-shape engaging head projecting in all directions from the upper end of the stem, since the engaging heads 23 branch and extend radially from the stem 21, even if the engaging head 23 hangs at its neck by the loop, the loop is allowed to smoothly move around the protuberances 23*a*' with a slight resistance, by a separating force greater than that with the conventional ordinary hook-shape engaging head and smaller than that with the conventional umbrella-shape engaging head, as the engaging head 23 resiliently deforms via the neck 22 to stand up when a peeling force is exerted on the surface fastener. As a result, it is possible to secure a required degree of engaging strength, despite of the minute size of the engaging heads 23, without causing any damage to either the engaging elements 2 and the loops.

Further, in the presence of the protuberances 23*a*', it is possible to modify the shape of the engaging head 23 as described above. Namely, since the protuberances 23*a*' cause an increased degree of engaging strength with the loops as mentioned above, the engaging head 23 can have a configuration that the engaging head 23 projects straightway slightly sloping upwardly as bending at and extending from the upper end of the stem 21. This facilitates inserting the engaging head 23 through even the minute-size loops, such as short and minute single-fiber pile bristling as part of an ordinary non-woven cloth.

In this embodiment, the engaging elements 2 in each adjacent rows are arranged in a staggering pattern so that the substrate sheet 1 is surely prevented from any tear perpendicular to the engaging element rows. Alternatively, the individual engaging elements 2 in each row are transversely aligned with those in its adjacent rows as shown in FIG. 6.

Figure 7:
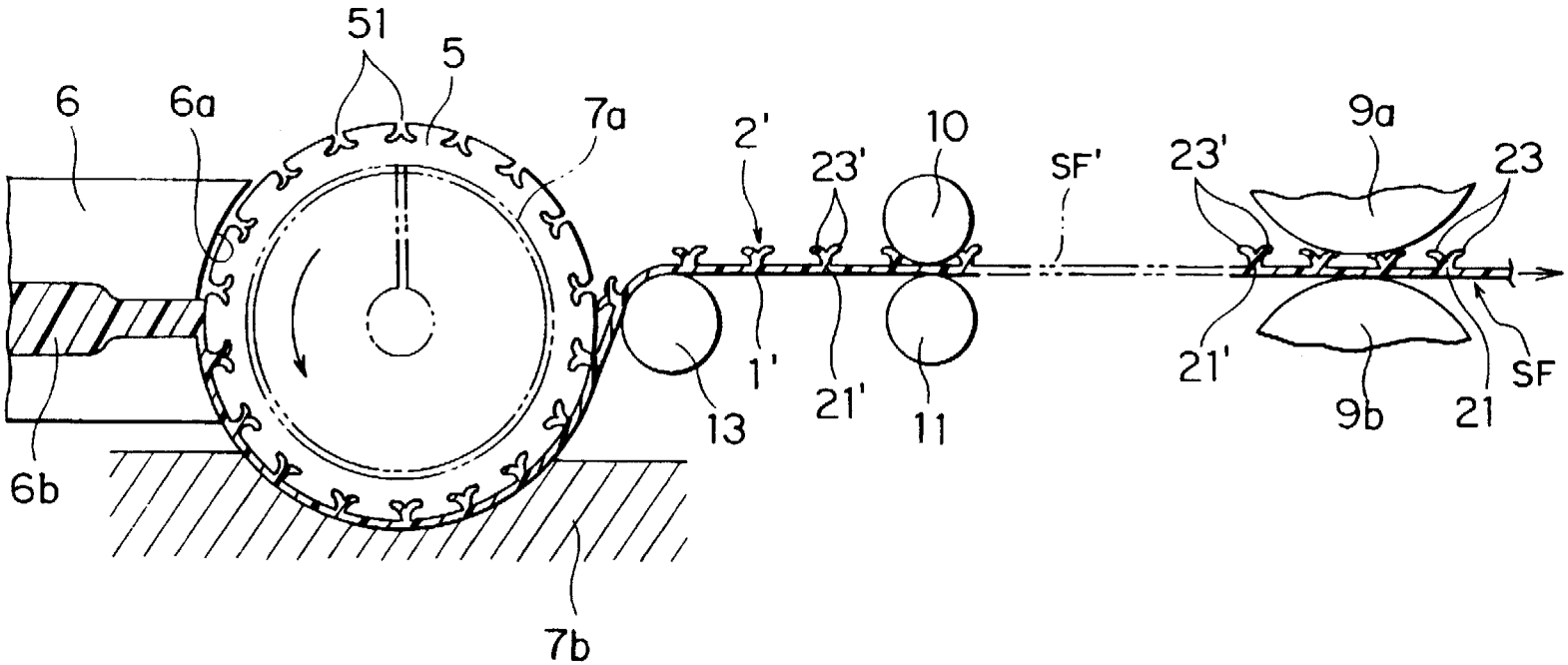
FIG. 7 is a cross-sectional view showing a general construction of an apparatus for manufacturing the molded surface fastener of this invention.

FIG. 7 is a fragmentary, enlarged view showing a general construction of an apparatus for continuously molding the surface fastener SF of this invention. In FIG. 7, reference numeral 6 is an injection nozzle, whose tip has an arcuate surface complementing the circumferential surface of a die wheel 5, for continuously extruding molten resin from an orifice 6*a*. The injection nozzle 6 is a T-type die disposed in a confronting relation to the circumferential surface of the die wheel 5 with a gap corresponding to the thickness of the substrate sheet 1, and a constant quantity of molten resin 4 is continuously injected in a sheet form from the orifice 6*a* at a predetermined resin pressure. In this embodiment, the injection nozzle 6 has a single central sprue 6*b*. The molten resin is exemplified by polypropylene, low-density polyethylene (LDPE), polyester elastomer, or nylon.

The die wheel 5 is a hollow drum having a water-cooling jacket 7*a* inside and composed of a multiplicity of non-illustrated ring-shape plates fixedly placed one over another along its axis in a laminate form. A circumferential surface of the die wheel 5 serves as a molding surface for molding the surface fastener SF. As described above, the gap is provided between the tip arcuate surface of the injection nozzle 6 and the die wheel 5 with the axis of the die wheel 5 being parallel to the orfice 6a. For molding the engaging elements 2, in the circumferential surface of the die wheel 5, engaging-element-forming cavities 51 are arranged in a plurality of rows spaced circumferentially at regular distances and extending parallel to the axis of rotation of the die wheel 5. There are a plurality of non-illustrated circumferential ring-shape grooves one between each adjacent pair of rows of cavities 51; each ring-shape groove serves as a cavity for molding part of the front surface of the substrate sheet 1 existing beside the stems 21 and the engaging heads 23. The die wheel 5 is driven by a non-illustrated known drive unit for rotation in the direction of an arrow in FIG. 7.

A lower part of the die wheel 5 is dipped in a cooling water bath 7b disposed under the die wheel 5. A vertical pair of take-up rollers 10, 11 is disposed downstream and diagonally upwardly of the cooling water bath 7b. A non-illustrated trimming unit also is disposed downstream and diagonally upwardly of the cooling water bath 7b for cutting edges of the primary-intermediate molded surface fastener SF', which is the blank of a final-product molded surface fastener SF. Further downstream of the trimming unit, a vertical pair of heating and pressing rollers 9a, 9b is provided for forming the protuberances 23a' of the engaging head 23.

Inside the upper roller 9a, a non-illustrated heating source is disposed so that the surface temperature of the roller 9a is set at a resin softening temperature. The lower end of the circumferential surface of the upper roller 9a is disposed at a level slightly below a horizontal plane passing the engaging head 23' of the primary-intermediate molded surface fastener SF'. The setup position of the upper roller 9a is determined according to a desired size of the protuberances 23a' bulging from the top 23a of the engaging head 23 of the engaging element 2 according to the invention. On the other hand, the upper surface of the lower roller 9b is disposed in a horizontal plane in which a rear surface of a substrate sheet 1' of the primary-intermediate surface fastener SF' travels. The vertical position of the upper roller 9a can be adjusted by a non-illustrated roller-level adjuster, and the heating temperature of the upper roller 9a can be adjusted as desired according to the kind of the resin material. Although both the upper and lower rollers 9a, 9b may be positively driven for rotation in synchronism with each other, at least the upper roller 9a is operatively connected to a drive source such as a non-illustrated electric motor to be rotated. The lower roller 9b may be substituted by a table having a less frictional flat top surface.

In order to mold the molded surface fastener SF of the invention by the apparatus having the above-described construction, when molten resin is continuously introduced from the injection nozzle 6 into the gap, which is defined between the rotating die wheel 5 and the orifice 6a, under a predetermined resin pressure, part of the molten resin fills the engaging-element-forming cavities and also then fills the gap to mold the substrate sheet 1'. Thus, a multiplicity of engaging element blanks 2' are integrally formed on the front surface of the substrate sheet 1' along the rotation of the die wheel 5. Thus the primary-intermediate molded surface fastener SF' is continuously molded.

While the primary-intermediate molded surface fastener SF' which is the blank of the surface fastener SF of the invention is moved along substantially a half of the circumferential surface of the die wheel 5 as being guided by a guide roller 13, this primary-intermediate surface fastener SF' is positively cooled by the water-cooling jacket 7a mounted in the die wheel 5 and, at the same time, the primary-intermediate surface fastener SF' is moved in and through the cooling water bath 7b, in which low-temperature (about 15°) cooling water circulates, and is thereby quickly cooled to facilitate solidification. Since the primary-intermediate molded surface fastener SF' is solidified by this quick cooling before crystallization of the molded surface fastener SF' starts, it is possible to make the whole substrate sheet 1' and all of the engaging elements 2' adequately soft.

When the solidified substrate sheet 1' is separated from the circumferential surface of the die wheel 5 by the take-up rollers 10, 11, the individual cooled and solidified engaging element blanks 2' are drawn successively from the engaging-element-forming cavities 51 smoothly as they resiliently deform into a straight shape. At that time, the engaging element blanks 2' tend to restore the original shape but do not completely, and an individual engaging head blank 23' has such a shape that the engaging head 23' stands from the stem 21' at a bending angle slightly upwardly compared to the Y-shape of the engaging-element-forming cavities 51.

The primary-intermediate surface fastener SF' is separated off the die wheel 5 using the upper and lower rollers 10, 11 rotating in opposite directions in synchronism with each other. Although the circumferential surfaces of the take-up rollers 10, 11 may be smooth, they are provided preferably with an elastic layer as of soft urethane so as not to damage the engaging elements 2. The primary molded surface fastener SF' is moved through a non-illustrated trimming unit, in which opposite side edges of the molded surface fastener SF' are cut off, and then through and between the upper and lower rollers 9a, 9b. While traveling through and between the upper and lower rollers 9a, 9b, the distal ends of the engaging head blanks 23' of the engaging element 2' are heated and pressed by the upper heating roller 9a so that the individual engaging head blank 23' is inclined slightly forwardly from its base end and, at the same time, deforms as softened from its top. As a result, the top 23a of the engaging head 23' is shaped so as to have a substantially flat top surface P and a pair of opposite side protuberances 23a' so that the engaging element 2 of the invention can be obtained. The flat top surface P may be slightly depressed at a central area due to the subsequent cooling, depending on the molding conditions.

In this invention, the molded surface fastener SF having passed through and between the upper and lower rollers 9a, 9b is slowly cooled at normal temperature without using separate cooling means, whereupon the molded surface fastener SF is wound up in a roll to finalize the manufacturing. It is important to heat and press the top of the engaging element 2 and to slowly cool the top 23a including the protuberances 23a'. Namely, while the heated top 23a of the engaging head 23 softened by being heated and deformed by pressing is cooled slowly, the heated portion becomes crystallized to have an increased degree of rigidness as compared to the stem 21 and the substrate sheet 1.

Since only the engaging head 23' has a high degree of rigidness as compared to the substrate sheet 1' and the majority of the engaging element 2', it is possible to provide adequate resistance against separation from the companion loops, though the engaging elements 2 are minute in size and very high in softness as the rigidity of the engaging heads 23 is secured. The resulting molded surface fastener SF is a high quality product having a less itchy touch on its engaging surface and an adequate degree of engaging strength, though excellent in softness and minute in size, guaranteeing good durability for repeated use.

Figure 8:
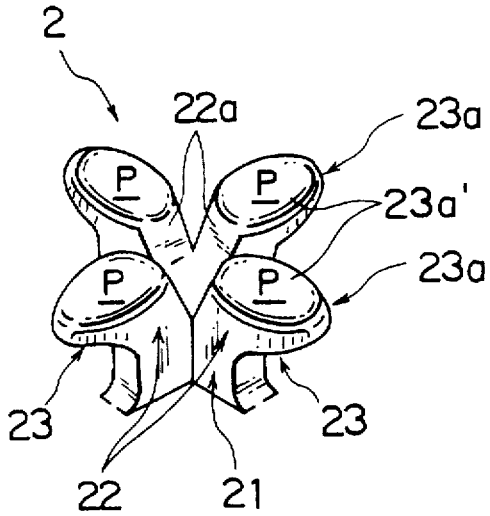
FIG. 8 is a fragmentary perspective view of a modified molded surface fastener according to a second embodiment of the invention.
Figure 9:
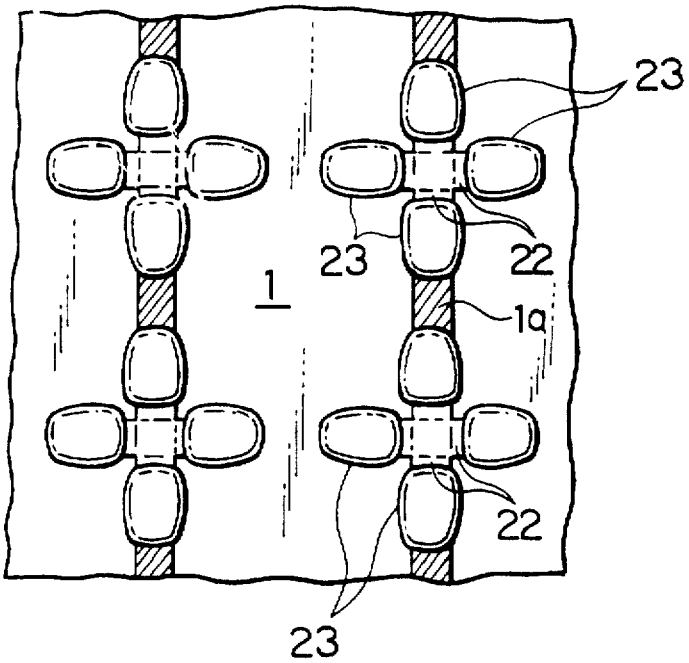
FIG. 9 is a fragmentary plan view of the modified molded surface fastener.
Figure 10:
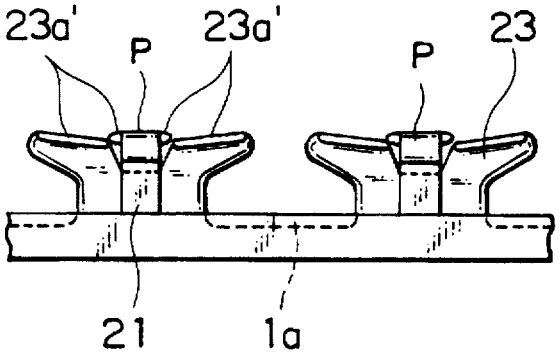
FIG. 10 is a fragmentary front view of the modified molded surface fastener.

In the foregoing embodiments, each of the engaging elements 2 is the double-head structure having two engaging heads 23 projecting in opposite directions from the single stem 21. In this invention, the number of engaging heads 23 branched from the single stem 21 should not be limited to two; for example, the engaging element 2 may have a four-head structure having four engaging heads branched in a cross from the single stem 21 as shown in FIGS. 8 through 10. The surface fastener having a multiplicity of such four-head engaging elements 2 is molded on a modified die wheel composed of a plurality of sets of ring-shape plates placed one over another in a hollow cylindrical drum. Each set is composed of five ring-shape plates for molding a single row of four-head engaging elements 2. A single ring-shape plate has in and along its circumferential edge a multiplicity of cavities each for forming one half of the whole stem 21 and one pair of opposed engaging heads 23; each of two second ring-shape plates to be placed on one on each of opposite sides of the first-mentioned ring-shape plate has a multiplicity of cavities each for forming half of the remaining other half of the stem 21; and each of another two ring-shape plates to be placed on the respective outer sides of the second-mentioned ring-shape plates has in and along its circumferential surface a multiplicity of cavities each for forming one of the other pair of opposed engaging heads 23 criss-crossing the above-mentioned pair of engaging heads 23.

As is apparent from the foregoing detailed description, according to the molded surface fastener SF of the invention having minute-size engaging elements 2, partly since the top surface of each of the number of substantially straight engaging heads 23 radiating in different directions from the single stem 21 of the individual engaging element 2 is shaped into a substantially flat surface bulging at opposite sides, and partly since each engaging head 23 has a varying thickness gradually decreasing toward its distal end, it is possible to improve the touch of the engaging heads 23 and to determine the angle of bending of the engaging head 23 with respect to the stem 21 larger than 90°. In this case, since the engaging head 23 is bent by an angle larger than 90° and has a varying thickness gradually decreasing toward its distal end, it is possible to facilitate inserting the engaging heads 23 through the companion loops. At the same time, since the protuberances 23*a*' bulging in opposite directions from opposite sides of the engaging head 23 serve to prevent the loops from accidental removal when a peeling force is exerted on the surface fastener SF in engagement with the companion surface fastener, it is possible to secure an required degree of peeling resistance. As a result, though the companion loops are minute in size, it is possible to guarantee sure engagement with the loops without any damage to the shape of the engaging heads 23. Furthermore, upon exertion of a peeling force on the surface fastener SF, the individual engaging head 23 deforms to flex the corresponding neck 22 so that the loop is allowed to move smoothly in the removing direction along the edges of the protuberances 23*a*' with necessary friction. Thus the loop can be removed from the engaging head 23 with ease.

According to the engaging elements 2 having the above-mentioned unique shape, the engaging elements 2 have an excellent touch, and reliable engagement with the minute-size loops can be secured and the engagement with the loops can be held at necessary strength. And further, it is possible to prevent occurrence of a so-called hanging phenomenon in which the neck 22 between the stem 21 and the engaging head 23 get entangled with the loops so that adequate peeling resistance and smooth separation can be achieved without any damage to either the loops or the engaging elements themselves thus degree of durability can be improved.

Further, when the protuberances 23*a*' of the engaging head 23 are formed by processing the engaging head 23 of the molded surface fastener, which is rapidly cooled after molding, with the heating and pressing means to slowly cool at normal temperature, the deformed top 23*a* of the engaging head 23 is slowly cooled to become solidified so that the engaging head 23 would increase in rigidness as compared to the stem 21, improving the degree of peeling resistance and guaranteeing adequate shape stability.

Furthermore, when the ratio of the total area of the flat top surfaces P of all the engaging heads 23 to the front surface area of the substrate sheet 1 is set larger than conventional, it is possible to display a much less itchy touch and to surely convey the molded surface fasteners by using sucking means when attaching to diapers or the like.

In addition, when the stem 21 has the engaging-head-projecting-side surface disposed substantially centrally under the top of the engaging head 23, it is possible to surely support the engaging head 23 on its bottom side and to prevent the engaging head 23 from being easily deformed even due to great pressure, thus avoiding any reduction of rate of engagement with the companion loop.

What is claimed is:

1. a synthetic resin molded surface fastener comprising:

(a) a substrate sheet; and (b) a multiplicity of engaging elements molded on a front surface of said substrate sheet for engagement with loops of a companion surface fastener;

(c) each of said engaging elements having multiple-head structure composed of a single stem standing on said front surface of said substrate sheet, two or more necks branching in different directions form an upper end of said stem, and two or more substantially straight engaging heads bent outwardly in branching directions from respective outer ends of said necks;

(d) each of said engaging heads having on its top a pair of substantially horizontal protuberances projecting perpendicularly to the branching direction of each said engaging head, said top having a substantially flat top surface.

2. A synthetic resin molded surface fastener according to claim 1, wherein each said engaging head has a varying thickness gradually decreasing at least around its distal end.

3. Synthetic resin molded surface fastener according to claim 2, wherein an uppermost point of each said engaging head is spaced from said front surface of said substrate sheet by a distance of 0.2–1.2 mm, each said engaging head projecting from said stem to an extent of 0.05–0.7 mm, said stem having a height of 0–1.0 mm.

4. A synthetic resin molded surface fastener according to claim 3, wherein a total area of said flat top surfaces of said tops of said engaging heads is 20–50% of the area of said front surface of said substrate sheet.

5. A synthetic resin molded surface fastener according to claim 4, wherein each said engaging head has a width, perpendicular to said extending direction, which is 50–70% of the sum of the total width of said pair of protuberances and said top.

6. A synthetic resin molded surface fastener according to claim 5, wherein said flat top surface of said top of each said engaging head is inclined with respect to the horizontal plane by an angle $\theta$ satisfying a relation $0<=\theta<=35°$, a lower surface of each said engaging head is inclined with respect to the horizontal plane by an angle $\theta'$ satisfying a relation $5<=\theta'<=45°$.

7. A synthetic resin molded surface fastener according to claim 6, wherein each said engaging head has at its distal end portion a vertical thickness 50–90% of the thickness at its base portion.

8. A synthetic resin molded surface fastener according to claim 7, wherein each said engaging head has a higher degree of rigidness than said stem.

9. A synthetic resin molded surface fastener according to claim 8, wherein said stem stands upright on said front surface of said substrate sheet and has an engaging-head-projecting-side surface disposed substantially centrally under said top of said engaging head.

10. A synthetic resin molded surface fastener according to claim 9, wherein confronting inner surfaces of said necks of each said engaging element extend from a central position of said upper end of said stem and are inclined away from each other.

11. A synthetic resin molded surface fastener according to claim 10, wherein a bottom of a hollow defined between said confronting inner surfaces of said necks is disposed substantially in a horizontal plane passing lower ends of bottom surfaces of said engaging heads.

12. A synthetic resin molded surface fastener according to claim 8, wherein confronting inner surfaces of said necks of each said engaging element extend from a central position of said upper end of said stem and are inclined away from each other.

13. A synthetic resin molded surface fastener according to claim 7, wherein at least said top of said engaging head including said protuberances has a higher degree of rigidness than the remaining portion of said engaging element.

14. A synthetic resin molded surface fastener according to claim 13, wherein said stem stands upright on said front surface of said substrate sheet and has an engaging-head-projecting-side surface disposed substantially centrally under said top of said engaging head.

15. A synthetic resin molded surface fastener according to claim 14, wherein confronting inner surfaces of said necks of each said engaging element extend from a central position of said upper end of said stem and are inclined away from each other.

16. A synthetic resin molded surface fastener according to claim 15, wherein a bottom of a hollow defined between said confronting inner surfaces of said necks is disposed substantially in a horizontal plane passing lower ends of bottom surfaces of said engaging heads.

17. A synthetic resin molded surface fastener according to claim 13, wherein confronting inner surfaces of said necks of each said engaging element extend from a central position of said upper end of said stem and are inclined away from each other.

18. A synthetic resin molded surface fastener according to claim 1, wherein said substrate sheet has at predetermined positions in said front surface a predetermined number of recesses, bottom surfaces of which said engaging elements stand on.

19. A synthetic resin molded surface fastener according to claim 18, wherein the height of said stem of each said engaging element from said bottom surface of the corresponding recess is 1/5–9/10 of the height of said uppermost point of said engaging head from said bottom surface of said recess.

20. A synthetic resin molded surface fastener according to claim 19, wherein each of said recesses has a width such as to receive the loops of the companion surface fastener.

21. A synthetic resin molded surface fastener according to claim 18, wherein each of said recesses has a width such as to receive the loops of the companion surface fastener.

22. A synthetic resin molded surface fastener according to claim 1, wherein an uppermost point of each said engaging head is spaced from said front surface of said substrate sheet by a distance of 0.2–1.2 mm, each said engaging head projecting from said stem to an extent of 0.05–0.7 mm, said stem having a height of 0–1.0 mm.

23. A synthetic resin molded surface fastener according to claim 1, wherein a total area of said flat top surfaces of said tops of said engaging heads is 20–50% of the area of said front surface of said substrate sheet.

24. A synthetic resin molded surface fastener according to any of claim 1, wherein each said engaging head has a width, perpendicular to said extending direction, which is 50–70% of the sum of the total width of said pair of protuberances and said top.

25. A synthetic resin molded surface fastener according to claim 1, wherein said flat top surface of said top of each said engaging head is inclined with respect to the horizontal plane by an angle $\theta$ satisfying a relation $\theta<=\theta<=35°$, a lower surface of each said engaging head is inclined with respect to the horizontal plane by an angle $\theta'$ satisfying a relation $5<=\theta'<=45°$.

26. A synthetic resin molded surface fastener according to claim 1, wherein each said engaging head has at its distal end portion a vertical thickness 50–90% of the thickness at its base portion.

27. A synthetic resin molded surface fastener according to claim 1, wherein each said engaging head has a higher degree of rigidness than said stem.

28. A synthetic resin molded surface fastener according to claim 1, wherein at least said top of said engaging head including said protuberances has a higher degree of rigidness than the remaining portion of said engaging element.

29. A synthetic resin molded surface fastener according to claim 1, wherein said stem stands upright on said front surface of said substrate sheet and has an engaging-head-projecting-side surface disposed substantially centrally under said top of said engaging head.

30. A synthetic resin molded surface fastener according to claim 1, wherein confronting inner surfaces of said necks of each said engaging element extend from a central position of said upper end of said stem and are inclined away from each other.

* * * * *